US008978790B2

(12) United States Patent
Nackerud

(10) Patent No.: US 8,978,790 B2
(45) Date of Patent: Mar. 17, 2015

(54) RETENTION OF CUTTERS IN BORE HOLE TOOLS

(76) Inventor: Alan L. Nackerud, Littleton, CO (US)

( * ) Notice: Subject to any disclaimer, the term of this patent is extended or adjusted under 35 U.S.C. 154(b) by 780 days.

(21) Appl. No.: 13/135,015

(22) Filed: Jun. 23, 2011

(65) Prior Publication Data

US 2011/0315449 A1 Dec. 29, 2011

Related U.S. Application Data

(60) Provisional application No. 61/398,370, filed on Jun. 24, 2010.

(51) Int. Cl.
*E21B 10/573* (2006.01)
*E21B 10/32* (2006.01)

(52) U.S. Cl.
CPC ..... *E21B 10/32* (2013.01); *E21B 10/573* (2013.01)
USPC ..... 175/435

(58) Field of Classification Search
CPC ..... E21B 10/573; E21B 10/567; E21B 10/55; B22F 2005/001
USPC ..... 175/435
See application file for complete search history.

(56) References Cited

U.S. PATENT DOCUMENTS

| | | | | |
|---|---|---|---|---|
| 4,711,144 | A * | 12/1987 | Barr et al. | 76/108.2 |
| 7,594,554 | B2 * | 9/2009 | Schwefe et al. | 175/428 |
| 8,268,452 | B2 * | 9/2012 | Lyons et al. | 428/577 |
| 2003/0079916 | A1 * | 5/2003 | Oldham et al. | 175/374 |
| 2007/0056776 | A1 * | 3/2007 | Overstreet | 175/426 |
| 2009/0308664 | A1 * | 12/2009 | Nackerud | 175/412 |

* cited by examiner

*Primary Examiner* — Shane Bomar
*Assistant Examiner* — Kipp Wallace

(57) ABSTRACT

A cutter retention method which uses brazed material placed in cutter pockets and cutter pocket grooves or recesses to allow braze material between the cutters and cutter pockets and in said grooves and overlapping onto the top of the cutters to better retain the cutters in the cutting bore hole tool apparatus for enhanced cutter retention and extended drilling or boring time of drill bits, underreamers, section mills hole openers, casing cutters or other down hole tools used in bore hole drilling and completion operations.

3 Claims, 4 Drawing Sheets

RETENTION OF CUTTERS IN BORE HOLE TOOLS

CROSS-REFERENCE TO RELATED APPLICATIONS

This application claims the benefit of provisional patent application Ser. No. 61/398,370 filed Jun. 24, 2010 by Alan L. Nackerud, which is incorporated by reference herein.

BACKGROUND AND FIELD OF INVENTION

Most conventional down hole tools used in the drilling and completion of bore holes in the earth such as drill bits, underreamers, section mills and casing cutters have cutters, cutting discs, inserts or cutting structures of hardened materials placed in the body of the tools to enhance cutting ability and lengthen drilling or cutting wear time. However, many cutting inserts such as PDC (polycrystalline diamond compact) cutters become loose, damaged or lost due to the fact that typical braze material used to retain the cutters does not bond well with the diamond or other hardened cutting materials and is only placed in the void between the cutter pocket diameter and the outside diameter of the cutters. Thus, the tool becomes ineffective and the tool life is shortened. The present invention is an improvement to said tools where grooves or recesses are cut into each cutter pocket just above or partially above the top level of the cutter. When the cutter is placed in position, braze material is then heated and applied in a liquid state to the groove and top of the cutter whereupon the braze material fills the grooves and then pools or overlaps onto the top of the cutters whereupon the braze material quickly cools and hardens thereby enhancing retention of the cutters similar to a snap ring retention device but more secure. In prior art the braze material only filled the void between the cutters and the pockets with no grooves or recesses. The present invention therefore allows enhanced cutter retention and extended drilling or boring time of drill bits, underreamers, section mills hole openers, casing cutters or other down hole tools used in bore hole drilling and completion operations. This same enhanced cutter retention is described in the present Inventors' patent application titled Drill bit with replaceable blade members, patent application Ser. No. 12/456,234, filed Jun. 11, 2009, wherefore a Terminal Disclosure has been filed with said provisional patent application Ser. No. 61/398,370 filed Jun. 24, 2010 by Alan L. Nackerud.

SUMMARY OF THE INVENTION

The above and other advantages and features will become more readily appreciated and understood from a consideration of the following detailed description taken together with the accompanying drawings in which:

DRAWINGS

Figures

DRAWINGS

Reference Numerals

Figure 1:
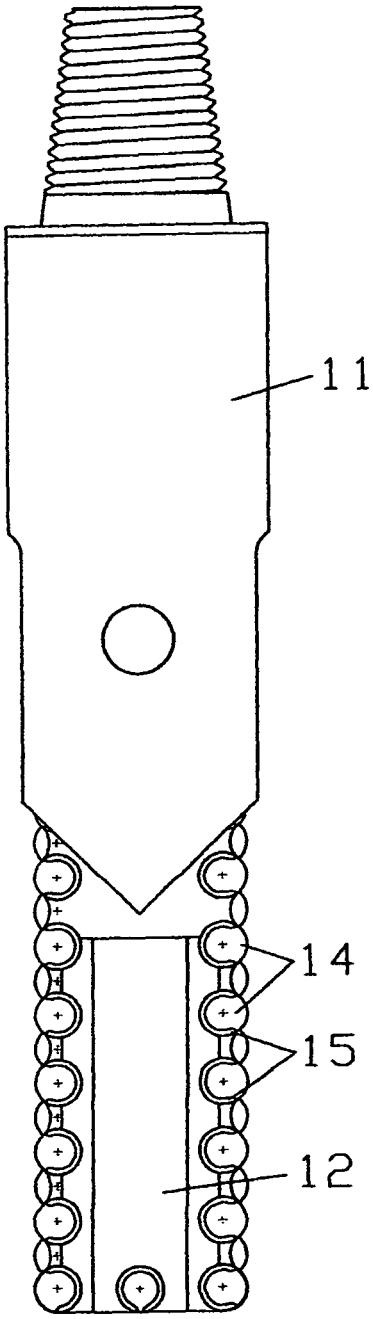
FIG. 1 is a side view of an Underreamer tool with retained cutters in a closed position.

10. threaded connection
11. body
12. blade one
13. blade two
14. cutters
15. braze material
16. cutter pocket
17. grooves

DETAILED DESCRIPTION

Figure 2:
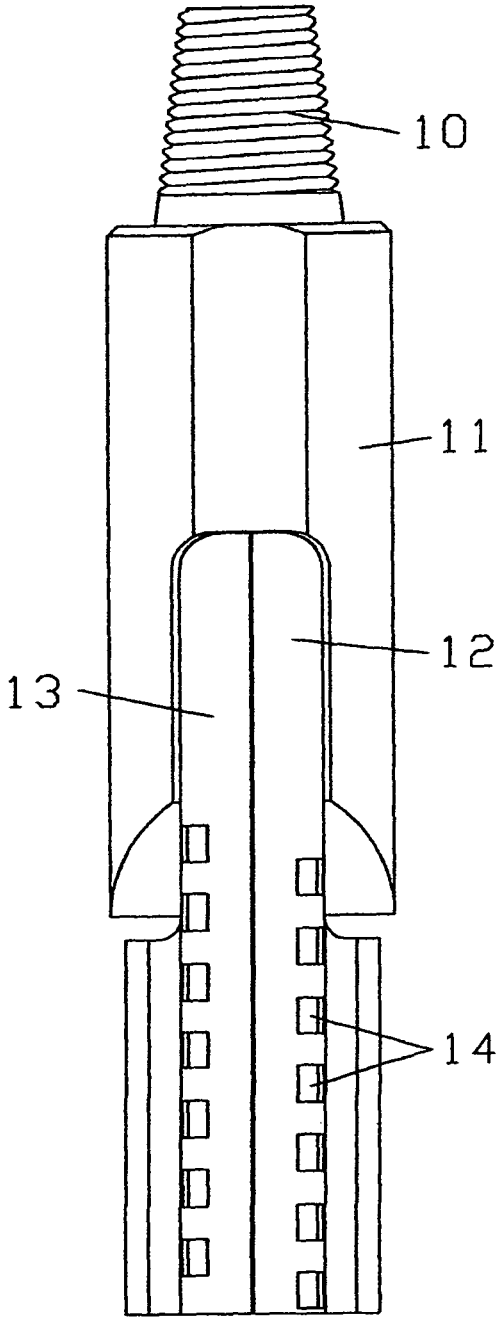
FIG. 2 is a side view of an Underreamer tool with retained cutters in a closed position rotated 90 degrees.
Figure 3:
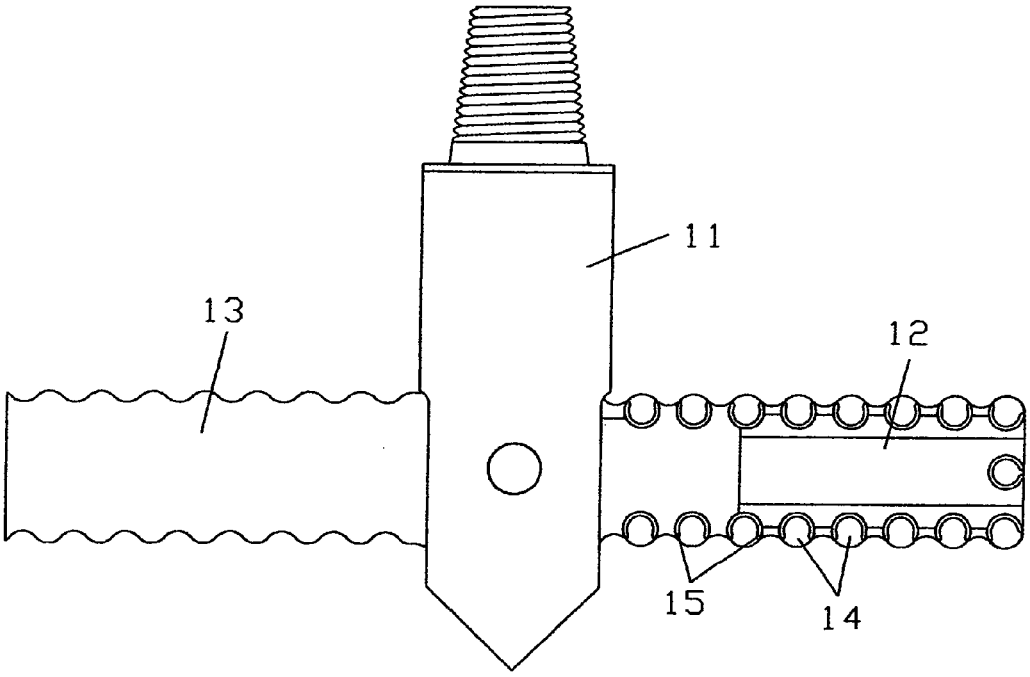
FIG. 3 is a side view of an Underreamer tool with retained cutters and blades in an open position.
Figure 4:
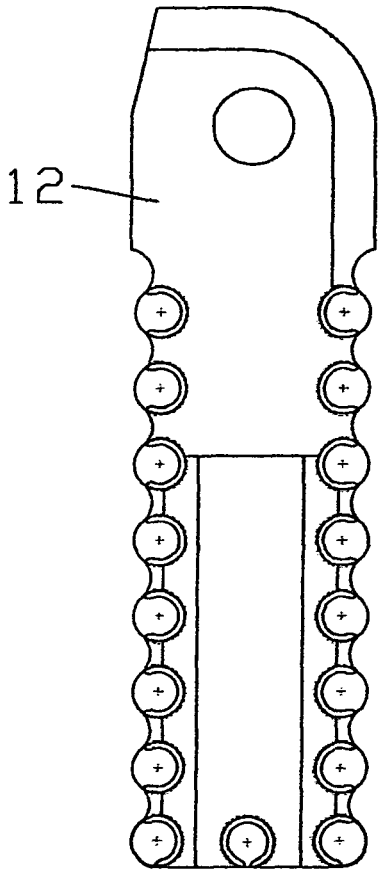
FIG. 4 is a side view of blade one of an Underreamer tool with retained cutters.
Figure 5:
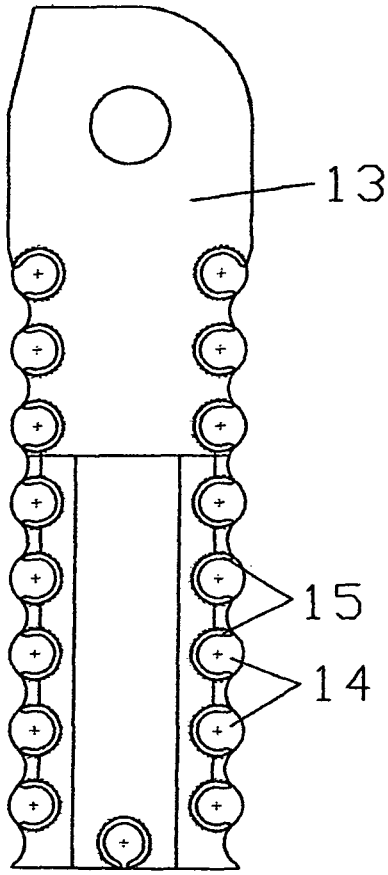
FIG. 5 is a side view of blade two of an Underreamer tool with retained cutters.
Figure 6:
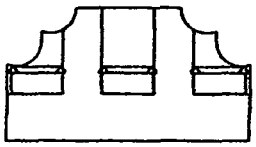
FIG. 6 is a section end view of blade one of an Underreamer tool with retained cutters.
Figure 7:
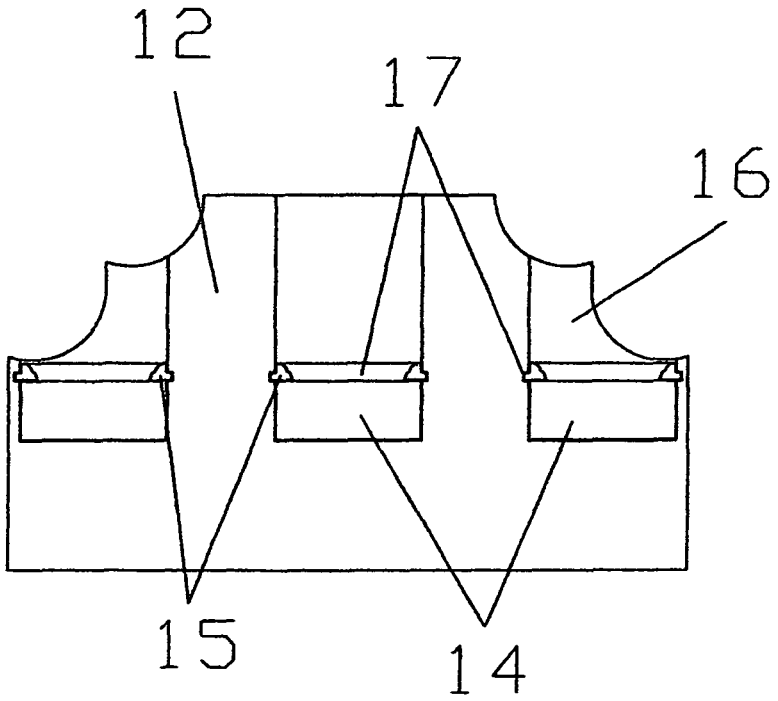
FIG. 7 is an enlarged section end view of blade one of an Underreamer tool with retained cutters showing grooves and braze material in grooves and on top of cutters.

Referring to the drawings, there is illustrated in FIGS. 1 through 7 one form of the present invention being an improved Underreamer with grooves 17 which contain braze material 15 which retains cutters 14 for retention of cutters 14 in blade one 12 and blade two 13. FIG. 1 and FIG. 2 show the Underreamer tool in a closed and non-operating position and FIG. 3 shows the Underreamer in an open and operating position. In FIGS. 1, 2 and 3 the Underreamer has a top threaded connection to allow connection to a drill string. The cutters 14 are placed in cutter pockets 16 around the drilling area perimeter of blade one 12 and blade two 13. Braze material 15 is heated and in a liquid state placed in grooves 17 near the top of cutters 14 wherein the braze material 15 fills grooves 17 and overlaps onto the tops of cutters 14 whereupon the braze material 15 hardens and retains cutters 14 in cutter pockets 16 for enhanced retention of cutters 14.

It is therefore to be understood that even though numerous characteristics and advantages of the present embodiment have been set forth in the foregoing description, together with the details of the structure and function of the embodiment, the disclosure is illustrative only, and changes may be made within the principles of the embodiment to the full extent indicated by the broad general meaning of the terms in which the claims are expressed and reasonable equivalents thereof and various forms of the present invention can be applied to numerous drilling and completion tools of earth bores.

I claim:

1. A method for retaining cutters of hardened material in a bore hole tool apparatus where cutters are located on a cutting or engagement area and fit into pockets, wherein the pockets have grooves cut into them, and wherein the grooves are located equal to and above or located partially below and above a top level of the cutters whereupon braze material means is heated and applied in a liquid state to said grooves whereupon the braze material fills said grooves and pools and overlaps onto the top of the cutters whereupon the braze material is allowed to cool and harden thereby adhering, locking in and retaining said cutters within said cutter pockets of said apparatus.

2. A method for retaining polycrystalline diamond compact (PDC) cutters of hardened material in a bore hole tool apparatus where PDC cutters are located on a cutting or engagement area and fit into pockets, wherein the pockets have grooves cut into them, and wherein the grooves are located equal to and above or located partially below and above a top level of the cutters whereupon braze material means is heated and applied in a liquid state to said grooves whereupon the braze material fills said grooves and pools and overlaps onto the top of the PDC cutters whereupon the braze material is allowed to cool and harden thereby adhering, locking in and retaining said PDC cutters within said cutter pockets of said apparatus.

3. A bore hole tool apparatus which has polycrystalline diamond compact (PDC) cutters located on a cutting or engagement area positioned around the perimeter of an apparatus cutting blade-s and fit into pockets, wherein the pockets have grooves cut into them, and wherein the grooves are located equal to and above or located partially below and above a top level of the cutters whereupon braze material means is heated and applied in a liquid state to said grooves whereupon the braze material fills said grooves and pools and overlaps onto the top of the PDC cutters whereupon the braze material is allowed to cool and harden thereby adhering, locking in and retaining said PDC cutters within said cutter pockets of said apparatus.

* * * * *